US006382855B1

(12) United States Patent
Katori

(10) Patent No.: US 6,382,855 B1
(45) Date of Patent: May 7, 2002

(54) KEY SHEET AND METHOD FOR MANUFACTURING THE SAME

(75) Inventor: Masaya Katori, Tokyo (JP)

(73) Assignee: Polymatech Co., Ltd. (JP)

( * ) Notice: Subject to any disclaimer, the term of this patent is extended or adjusted under 35 U.S.C. 154(b) by 0 days.

(21) Appl. No.: 09/566,336

(22) Filed: May 8, 2000

(30) Foreign Application Priority Data

May 24, 1999 (JP) ..... 11-142568

(51) Int. Cl.[7] ..... B41J 5/12
(52) U.S. Cl. ..... 400/494; 200/314
(58) Field of Search ..... 400/490, 493, 400/494; 200/5 A, 302.2, 314, 313, 345, 512, 514

(56) References Cited

U.S. PATENT DOCUMENTS 5,807,002 A * 9/1998 Tsai ..... 400/494
5,911,317 A * 6/1999 Tsai ..... 200/514
6,180,896 B1 * 1/2001 Naritomi ..... 200/5 A
6,278,072 B1 * 8/2001 Nakajo ..... 200/341

FOREIGN PATENT DOCUMENTS

| | | | |
|---|---|---|---|
| JP | 54-154461 | | 12/1979 |
| JP | 63-86014 | * | 4/1988 |
| JP | 7-54656 | | 6/1995 |
| JP | 10-289633 | * | 10/1998 |
| JP | 11-176273 | * | 7/1999 |
| JP | 11-227257 | * | 8/1999 |
| JP | 2000-268667 | * | 9/2000 |
| JP | 2001-126577 | * | 5/2001 |

* cited by examiner

*Primary Examiner*—Ren Yan
(74) *Attorney, Agent, or Firm*—McGlew and Tuttle, P.C.

(57) ABSTRACT

A key sheet having a layer and a display section with the sense of the mirror surface is realized at a low cost, in addition, the key sheet which also embodies a illuminating effects is provided. In the key sheet integrated with a film 2 on a surface and a side of a key top body 1 made of a thermoplastic resin, an inorganic substance layer 3 which is 20 to 100 nm in thickness and is 1 to 20% in a transmittance of visible light is formed on the back face of the film.

6 Claims, 2 Drawing Sheets

KEY SHEET AND METHOD FOR MANUFACTURING THE SAME

BACKGROUND OF THE INVENTION

1. Technical Field of the Invention

The present invention relates to a compact and size-reduced key sheet used for various portable equipment with a terminal for a mobile communication system such as a portable telephone or a motor-vehicle telephone.

2. Related Art

In recent years, there has been a sheet-shaped key top made by combining a plastic film with a key top body made of thermoplastic resin in a push button used for the portable equipment.

As its manufacturing method, the method has been described in Japanese Laid-open Patent Publication No. SHO. 54-154461 and Japanese Patent Publication No. HEI. 7-54656, in which a resin film are molded integrally with the key top body by putting a resin film between the mold to injection-mold the thermoplastic resin.

As shown in FIG. 3, these are the manufacturing methods that a display section 8 and a colored layer 6 are applied by printing on a surface or a back face of a plane film 2 to put the resin film between a mold and then to inject the thermoplastic resin, thereby molding the key top body 1 and forming integrally the plane-shaped film 2 with the key top body 1.

At present, a color tone of the display section has come to be various kind of color tones as an achromatic color such as black and gray, chromatic color such as red, blue and green, and a metallic color such as gold or silver. The metallic color of all is obtained by mixing aluminum powder and mica powder or the like and pigment into paint and ink or the like.

Recently, a requirement for the display section with the sense of a mirror surface has been increased. However, it has been difficult to realize the display section and the layer with the sense of the mirror surface as obtained by manufacturing methods such as a plating process or hot stamping by application such as coating or printing on the surface.

As the general manufacturing method of the layer and the display section with the sense of the mirror surface, it has been known that on a surface of the key top body molded into a predetermined shape in advance is provided the layer and the display section with the sense of the mirror surface by the plating process or hot stamping. Since the layer and the display section are worn in practical uses, it becomes necessary to give wear-resistance resin coating on the surface of the display section, resulting in frequent occurrence of defects due to dust and foreign matters at mass production and an increase in cost of manufacturing due to an increase of the number of production processes.

On the other hand, although it has been studied that the layer or the display section with the sense of the mirror surface is provided by plating process or hot stamping on the back face of the plane film to draw the film into a predetermined shape and to mold integrally with the thermoplastic resin, the layer with the sense of the mirror surface can not follow elongation of the film on the occasion of drawing process of the film, so that a crack or the like is occurred, therefore, it also has been not preferable from the outside appearance.

Furthermore, it is also required to combine with a lightening function through the sense of the mirror surface and a backup light.

SUMMARY OF THE INVENTION

The invention, for solving the problems described above, is to realize a key sheet having the layer or a display section with the sense of the mirror surface by providing at a low cost an inorganic substance of a thin film which a crack is not occurred even though being drawn on the back of the film, and in addition, to provide the key sheet which also embodies the illuminating effects.

That is the invention provides a key sheet which a film is integrated on a surface and a side of a key top body made of thermoplastic resin, said key sheet comprising on the back face of the film an inorganic substance layer which is 20 to 100 nm in thickness and is 1 to 20% in a transmittance of visible light.

Furthermore, the invention provides a key sheet of a vacuum evaporation layer which is formed by a physical vapor deposition method or a chemical vapor deposition.

Furthermore, the invention provides a key sheet which the inorganic substance layer forms a hollow-character shaped display section.

Furthermore, the invention provides a key sheet which a display section is formed between the film and the inorganic substance layer.

The inorganic substance layer according to the invention is preferably 20 to 100 nm in thickness and 1 to 20% in a transmittance of visible light. When the thickness of the layer is less than 20 nm, the sense of the mirror surface can not be obtained due to the thinness.

Moreover, since a crack becomes tendency to occur on the occasion of drawing processing of the film, the illuminating effects can not be obtained when the thickness of the layer exceeds 100 nm. The more preferable range is 40 to 80 nm. Moreover, when the transmittance of visible light is less than 1%, the illuminating effects by the backup light can not be obtained. Moreover, when the transmittance of visible light exceeds 20%, the sense of the mirror surface becomes not able to obtain. The further preferable range is 2 to 15 nm. The transmittance of visible light of the invention conforms to the method of JIS K-7105.

The inorganic substance layer according to the invention is preferably the vacuum evaporation layer and is formed by the physical vapor deposition or the chemical vapor deposition. By either of the methods, an uniform film without inconsistencies can be formed, and an ion plating method, a sputtering method or the like is given in the physical vapor depositions, and a plasma CVD method, a photo assisted CVD method or the like is given in the chemical vapor depositions.

A thermoplastic resin according to the invention is preferable the thermoplastic resin with transparency, and a polyethylene resin, a polypropylene resin, a polystyrene resin, a polycarbonate resin, a polyacrylic resin, a polymethacrylic acid resin and a polyamide resin are given.

As the film according to the invention, all the films can be available as far as being the film excellent in transparency. In particular, a haze is preferably less than 10%. Moreover, a material is preferable a nonextensible polyamide film or an alloy film of a polycarbonate and a poly-butylene-terephthalate or the like is preferable, taking drawing property into account.

Furthermore, 50 to 200 nm is adaptable in the film thickness.

The material used for the inorganic substance layer according to the invention is preferably aluminum or chromium which the sense of the mirror surface is easy to be manifested at a low cost.

An ink used for the display section, a coloring layer, a protective layer, a holding layer or the like of the invention is selected and used properly from an urethane base ink, acrylic base ink, a vinyl base ink, a polycarbonate base ink and a polyester base ink or the like, taking an adhesion between each of layers into account.

DETAILED DESCRIPTION OF THE PREFERRED EMBODIMENTS

A typical embodiment according to the invention will be described.

Figure 1:
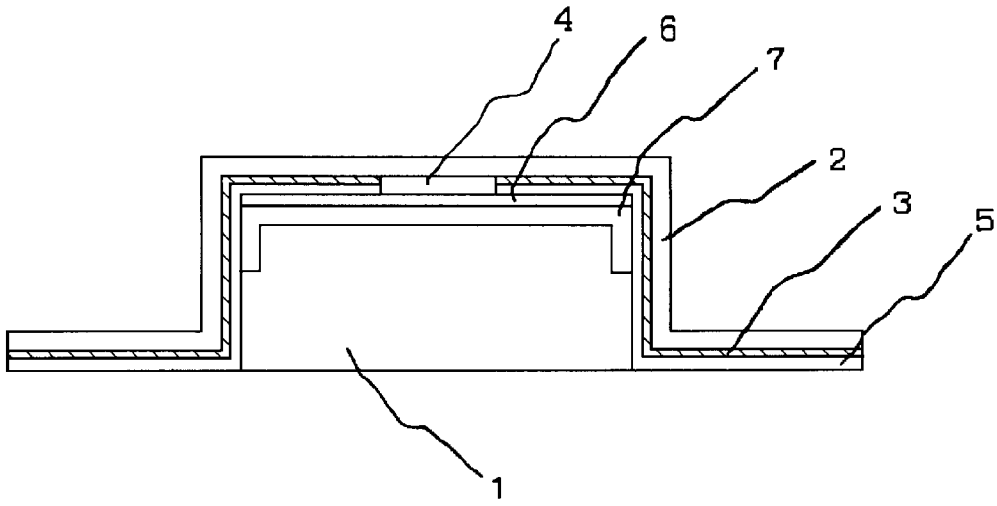
FIG. 1 is a sectional view of a key sheet according to the invention.

As shown in FIG. 1, it is a key sheet in which a film 2 is integrated on the surface and the side of the key top body 1 made of the thermoplastic resin, the key sheet comprising an inorganic substance layer 3 which is 20 to 100 nm in thickness and is 1 to 20% in a transmittance of visible light on the back face of the film 2, the inorganic substance layer forming a hollow-character shaped display section 4.

This form of key sheet was manufactured: by vacuum-evaporating the inorganic substance layer 3 on the back of the film 2 to screen-print a hollow-character shaped protective layer 5 thereon to immerse into an alkaline and acidic aqueous solution and to etch the vacuum evaporation layer thereby forming the display section 4. Furthermore, the film 2 is molded integrally with the key top body 1 by putting the deformed film between the mold to injection-mold the thermoplastic resin, after screen-printing a coloring layer 6 and a holding layer 7 on this display section to draw with the mold preheated as required.

Figure 2:
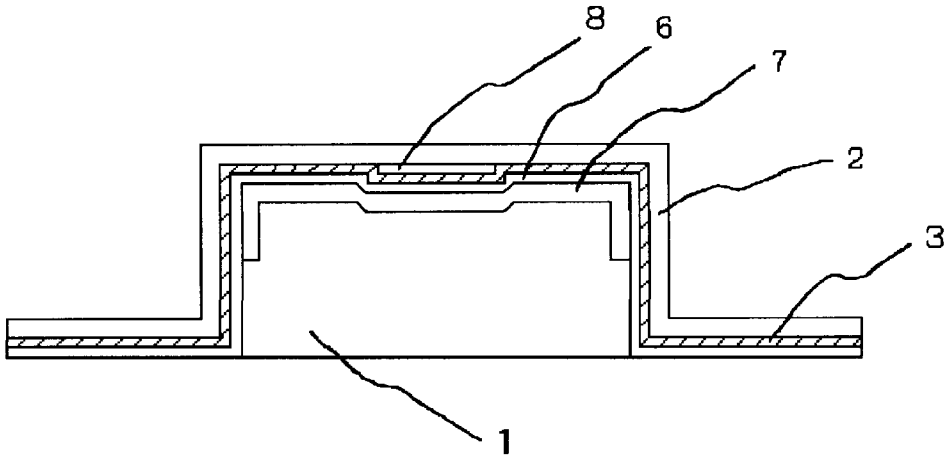
FIG. 2 is a sectional view of another key sheet according to the invention.
Figure 3:
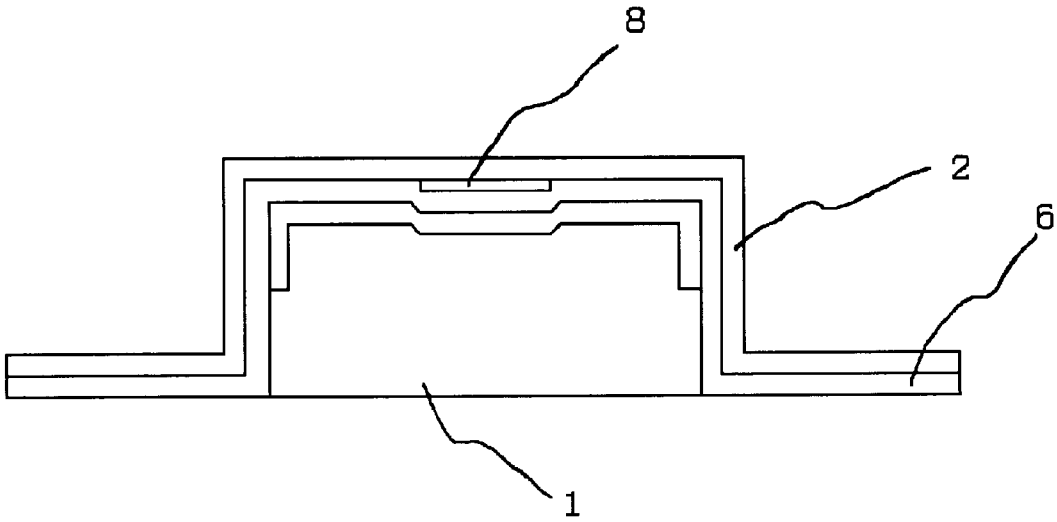
FIG. 3 PRIOR ART
FIG. 3 is a sectional view of a key sheet of the prior art.

As shown in FIG. 2, as an another embodiment, it is a key sheet in which a display section 8 is interposed between the film 2 and the inorganic substance layer 3. This form of key sheet was manufactured: by printing the display section 8 on the back face of the film 2 by means of existing printing methods such as screen-printing, gravure-printing and off-setting printing to evaporate the inorganic substance layer 3 thereon. Furthermore, the film 2 is molded integrally with the key top body 1 by putting the deformed film between the mold to injection-mold the thermoplastic resin, after screen-printing a coloring layer 6 and a holding layer 7 as required on this inorganic substance layer to draw with the mold preheated as required.

Hereinafter, embodiments according to the invention will be described. Moreover, all members such as the film and the ink which are expressed in the embodiments are of typical, therefore, the invention is not limited thereto.

EMBODIMENT 1

A surface of an alloy film (Bayfol, made by Bayer Co.) of a polycarbonate and a poly (butylene terephthalate) of 100 μm in thickness was surface-modified by a corona modifying equipment. Aluminum was vacuum-evaporated in the form of 60 nm in thickness and 1 to 2% in a transmittance of visible light by a vacuum evaporation equipment, after completely removing dust, foreign matters on this film surface. This film in which the inorganic substance was vacuum-evaporated was cut into the appropriate size and to coat the coloring layer on the vacuum evaporation layer with the urethane base ink (RUX, made by Seiko Advance Co.), combining with an improvement of the adhesion on integrally molding. This film was drawn by the mold for compressing molding to deform into a predetermined-key shape. The film was molded integrally with the key top body by putting this film which was drawn by the mold for compressing molding between the injection molding machine to injection-mold the polycarbonate resin (Iupilon, made by Mitsubishi Engineering Plastics Co.). The key sheet with the sense of the mirror surface was obtained by cutting the outer periphery of the moldings molded integrally by means of stamping process.

EMBODIMENT 2

A surface of 100 μm in thickness of the nonextensible polyamide film (Diamiron C, made by Mitsubishi Jyusi Co.) extruded by T-die method was surface-modified by the corona modifying equipment. Aluminum was vacuum-evaporated in the form of 80 nm in thickness and 1% in a transmittance of visible light by a vacuum evaporation equipment, after completely removing dust, foreign matters on this film surface. The hollow-character shaped display section was screen-printed on the vacuum evaporation layer of the film on which the inorganic substance was vacuum-evaporated with a black urethane base ink (RUX, made by Seiko Advance Co.). The film was immersed into a potassium hydroxide aqueous solution to remove the vacuum evaporation layer forming character-shaped portions except for the printed layer. Furthermore, the film was immersed into a dilute sulfuric acid to neutralize the film and then to clean by immersing into a purified water. The holding layer suppressing deformation of the optically transparent coloring layer and the display section, combining with an improvement of the adhesion on integrally molding, was printed thereon. The film was drawn by the mold for compressing molding to deform into a predetermined-key shape. The film was molded integrally with the key op body by putting and holding this film which was drawn by the mold for compressing molding between the mold to injection-mold the polycarbonate resin (Iupilon, made by Mitsubishi Engineering Plastics). The character-glowing key sheet with the sense of the mirror surface glowed from the display section was obtained by cutting the outer periphery of the moldings molded integrally by means of stamping process.

EMBODIMENT 3

A surface of 100 μm in thickness of the nonextensible polyamide film (Diamiron C, made by Mitsubishi Jyusi Co.) extruded by T-die method was surface-modified by the corona modifying equipment. The display section such as characters or symbols is printed on the surface of the film. Furthermore, aluminum was vacuum-evaporated in the form of 40 nm in thickness and 3 to 6% in a transmittance of visible light by the vacuum evaporation equipment on the film. The holding layer suppressing deformation of the display section and combining with an improvement of the adhesion on integrally molding was printed with the urethane base ink (RUX, made by Seiko Advance Co.) on the vacuum evaporation layer of the film on which the inorganic substance was vacuum-evaporated.

The film was drawn by the mold for compressing molding to deform into a predetermined-key shape. The film was molded integrally with the key top body by putting and holding the film which was drawn by the mold for compressing molding between the injection mold to injection-mold the polycarbonate resin (Iupilon, made by Mitsubishi Engineering Plastics Co.). The key sheet with the sense of the mirror surface which the whole of the key sheet surface is glowed was obtained by cutting the outer periphery of the moldings molded integrally by means of stamping process.

EMBODIMENT 4

A surface of the polycarbonate film (Makrofol, made by Bayer) of 100 $\mu$m in thickness was surface-modified by the corona modifying equipment. The display section such as characters and symbols is printed on the surface of the film. Furthermore, aluminum was vacuum evaporated in the form of 20 nm in thickness and 5~12% in a transmittance of visible light by the vacuum evaporation equipment on the film. The holding layer suppressing deformation of the display section and combining with the improvement of the adhesion on integrally molding was printed on the evaporated layer of this film vacuum-evaporating the inorganic substance with the urethane base ink (RUX, made by Seiko Advance Co.). The film was drawn by the mold for compressing molding to deform into a predetermined-key shape. The film was molded integrally with the key top body by putting and holding the film which was drawn by the mold for compressing molding between the injection mold to injection-mold the polycarbonate resin (Iupilon, made by Mitsubishi Engineering Plastics Co.). The key sheet with the sense of the mirror surface on which the whole of the key sheet surface is glowed was obtained by cutting the outer periphery of the moldings molded integrally by means of stamping process.

The present invention has the following effects and superiority to the prior arts.

A key sheet according to the invention can be formed as the key sheet having an inorganic substance layer with the sense of the mirror surface at the back face of the film, because the film is drawn after forming the inorganic substance layer which is 20 to 100 nm in thickness and is 1 to 20% in a transmittance of visible light. Therefore, the inorganic substance layer is formed as a vacuum evaporation layer, thereby the laminated inorganic substance layer is able to follow to the film for drawing of the film, whereby the key top body preferable from the viewpoint of an outside appearance without crack or the like can be obtained.

In the key sheet according to the invention, the inorganic substance layer is formed on the back face of the film, thereby wear can not be caused in practical uses, moreover, any coating layer is not required to provide on the surface thereof, whereby a key sheet can be formed with high reliability and at a low cost.

What is claimed is:

1. A key sheet integrated with a film on a surface and a side of a key top body made of thermoplastic resin, comprising:

an inorganic substance layer which is 20 to 100 nm in thickness and is 1 to 20% in a transmittance of visible light on the back face of the film.

2. The key sheet according to claim 1, wherein the inorganic substance layer is a vacuum evaporation layer which is formed by a physical vapor deposition or a chemical vapor deposition.

3. The key sheet according to claim 2, wherein a hollow-character shaped display section is formed on the inorganic substances layer.

4. The key sheet according to claim 2, wherein a display section is formed between the film and the inorganic substance layer.

5. The key sheet according to claim 1, wherein a hollow-character shaped display section is formed on the inorganic substances layer.

6. The key sheet according to claim 1, wherein a display section is formed between the film and the inorganic substance layer.

* * * * *